US005596788A

United States Patent [19]

Linville et al.

[11] Patent Number: 5,596,788

[45] Date of Patent: Jan. 28, 1997

[54] VACUUM SWEEPER VEHICLE WITH LIGHTWEIGHT HOPPER

[76] Inventors: Ronny E. Linville, 4984 Casa Loma Cir.; Roger D. Linville, 5464 Lakeview St., both of Yorba Linda, Calif. 92686

[21] Appl. No.: 389,588

[22] Filed: Feb. 16, 1995

Related U.S. Application Data

[63] Continuation-in-part of Ser. No. 337,776, Nov. 14, 1994, abandoned.

[51] Int. Cl.[6] ..... E01H 1/08

[52] U.S. Cl. ..... 15/352; 15/340.1; 15/346

[58] Field of Search ..... 15/347, 348, 349, 15/340.1, 340.3, 340.4, 346

[56] References Cited

U.S. PATENT DOCUMENTS

| | | | |
|---|---|---|---|
| 2,523,808 | 9/1950 | Boyce et al. . | |
| 2,887,714 | 5/1959 | Hanson | 15/347 X |
| 3,036,326 | 5/1962 | Hanson et al. | 15/340.1 X |
| 3,634,904 | 1/1972 | Larsen . | |
| 3,971,400 | 7/1976 | Thompson . | |
| 4,017,281 | 4/1977 | Johnstone . | |
| 4,160,302 | 7/1979 | Hirst et al. . | |
| 4,199,837 | 4/1980 | Fisco | 15/340.1 X |
| 4,578,840 | 4/1986 | Pausch . | |
| 4,660,248 | 4/1987 | Young | 15/347 X |
| 4,729,570 | 3/1988 | Welch . | |
| 4,885,817 | 12/1989 | Tanase | 15/347 X |
| 5,042,840 | 8/1991 | Rieple . | |
| 5,218,737 | 6/1993 | Dansby . | |
| 5,287,684 | 2/1994 | Beroth . | |
| 5,317,783 | 6/1994 | Williamson | 15/347 X |

*Primary Examiner*—Chris K. Moore

*Attorney, Agent, or Firm*—Fulwider Patton Lee & Utecht, LLP

[57] ABSTRACT

A vacuum sweeper vehicle including a hopper mounted to the vacuum truck chassis, a vacuum system for drawing a predetermined partial vacuum at a vacuum inlet and a suspended vacuum sweeper head having a debris conduit leading to a debris outlet. The hopper has a seamless fiberglass tank formed with a front wall having a vacuum outlet for mating with the vacuum inlet and a debris inlet for mating with the debris outlet. The tank has top and bottom walls and is formed with pairs of laterally disposed respective upper and lower longitudinally extending rounded corners formed integrally between laterally disposed side walls. The rear end of the tank is open to form a debris removal outlet and a rear door is hingedly connected to the rear of the tank to be disposed in closing relation over the rear of the tank. In addition, the tank includes a screen and a diverter interposed between the debris inlet and vacuum outlet that cooperate to direct air flow from the debris inlet through the screen to the vacuum outlet.

21 Claims, 5 Drawing Sheets

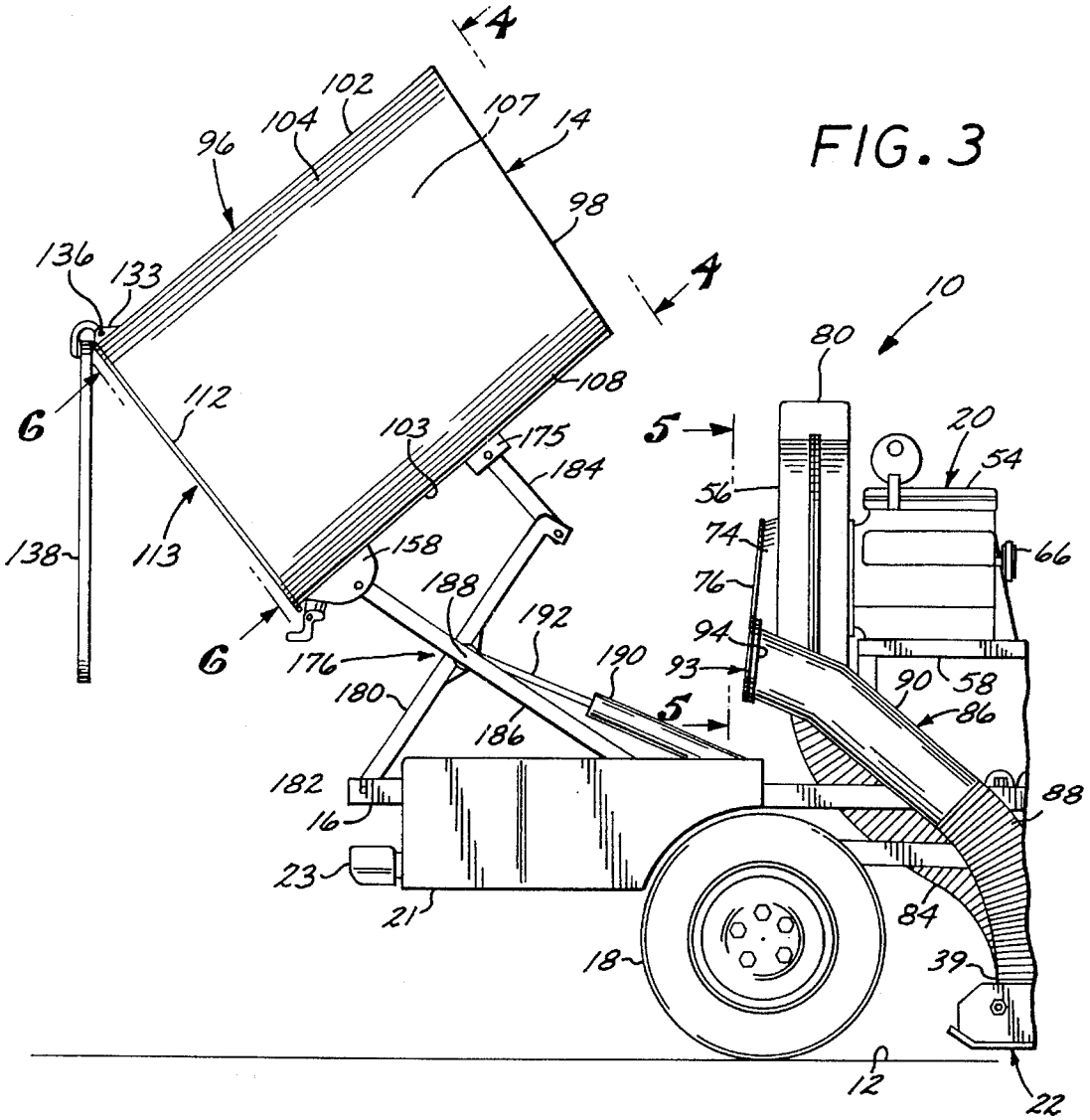
FIG. 3
FIG. 4
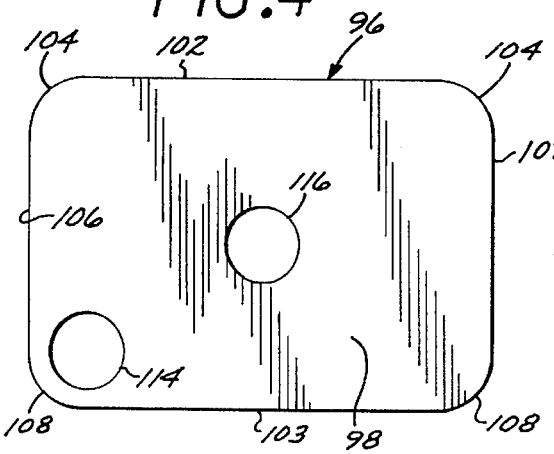
FIG. 5
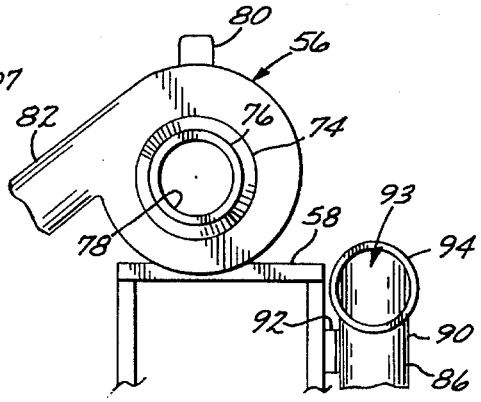

FIG. 6
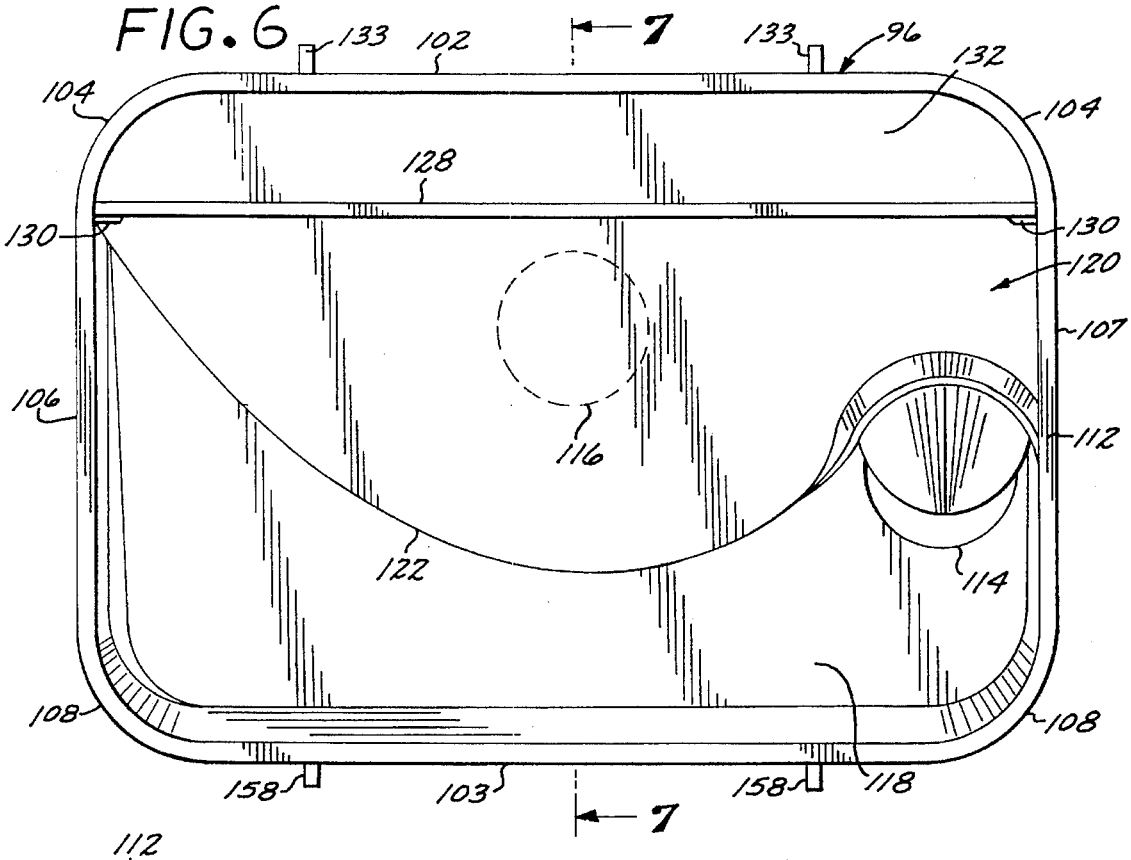
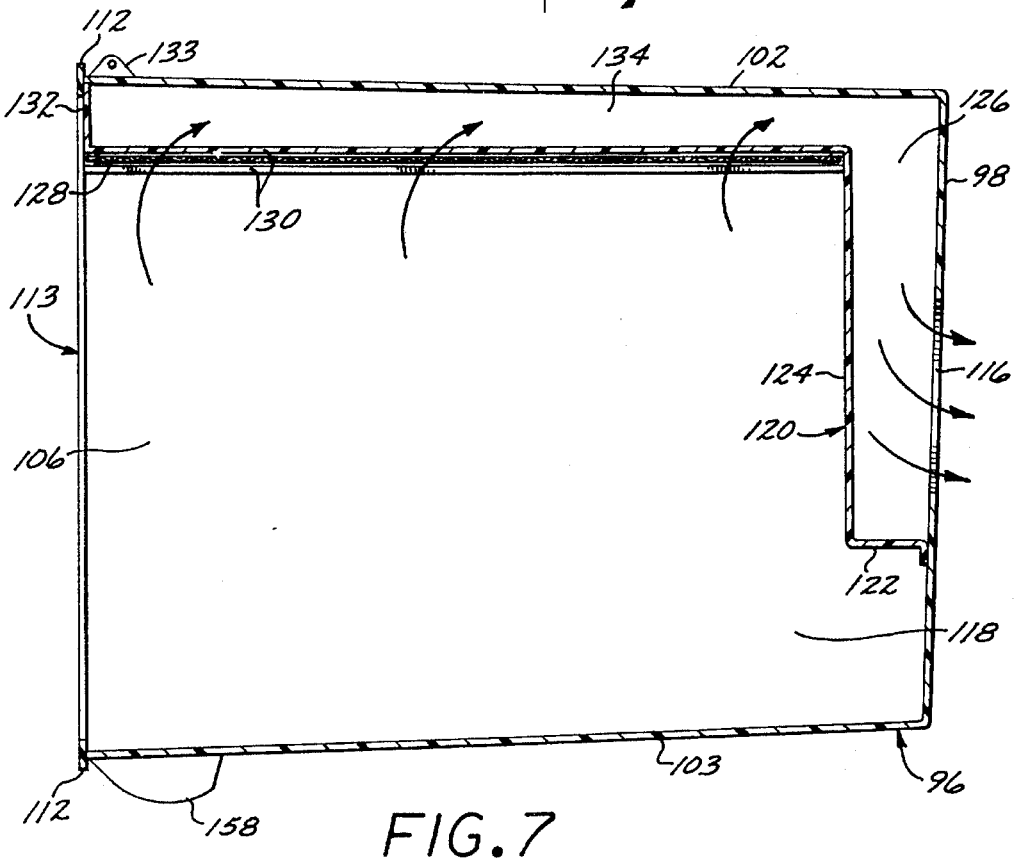
FIG. 7

VACUUM SWEEPER VEHICLE WITH LIGHTWEIGHT HOPPER

This is a continuation-in-part of application Ser. No. 08/337,776 filed on Nov. 14, 1994, now abandoned.

BACKGROUND OF THE INVENTION

1. Field of the Invention

The present invention is related to vacuum sweeping vehicles for collecting debris from streets and parking lots, and more particularly to such vehicles which are lightweight.

2. Description of the Prior Art

For a number of years, street sweepers and the like have been used to maintain the cleanliness of expansive paved spaces. Typically, street sweepers are mounted on a heavy duty truck or vehicle having a water storage tank, rotatable brushes, vacuum system driven by a separate engine, and a large hopper in which swept up debris is collected. Typically, intricate heavy duty hydraulic systems and mechanisms are incorporated for dumping the hopper, extending and retracting brushes, and the like. Because of the collective weight of all of these systems and components, heavy duty large trucks or vehicles are employed to provide the required capacity to carry the weight of the mechanism and any trash collected in the hopper. Experience has proven that, not only are such sweepers large, bulky, costly to manufacture, fuel inefficient, and possess limited maneuverability, but have restricted capacity because of typical governmental weight restrictions imposed on the road over which such vehicles operate in the collection and disposal of trash.

Consequently, in some instances, the industry adopted the use of less sophisticated vacuum trucks, usually incorporating fewer peripheral components sometimes limited to a vacuum suction head for sucking debris into a vacuum system driven by a separate drive engine to collect debris into a smaller debris collection hopper. These less sophisticated systems, being more cost effective and lighter for mounting on a truck with a smaller wheel base and thus more maneuverable; however may constitute a compromise in performance.

These newer generation vacuum trucks, while having gained a certain degree of commercial success, continue to share certain shortcomings with the traditional heavier sweepers. They typically incorporate a debris hopper constructed of thick, 12 gauge steel to withstand the pressure differential generated by the vacuum acting on the interior of the hopper when in operation. Even with smaller hoppers, the weight thereof may be on the order of 1,600 lbs. thus requiring a vehicle with a rear axle load capacity on the order of one ton. Such vehicles may be of considerable size, relatively expensive to procure and suffer from fuel inefficiency.

The manufacture of a steel hopper of this type typically involves cutting steel to size to define the walls of the hopper. The walls are erected and the adjacent edges welded together to form a generally box-shaped hopper having pronounced oblique angled junctions. In operation, the hopper is subjected to vacuum induced air flow. Such box-shaped hopper construction provides a relatively inefficient flow path often producing stagnation flow areas near the oblique junctions of the hopper walls and tending to cause eddies and turbulent air flow patterns within the hopper. Such air flow characteristics can provide resistance to uniform air flow and cause debris to churn within the hopper rather than collecting in an efficient manner along the bottom wall. Moreover, these air flow characteristics decrease vacuum efficiency, serving to detract from the efficiency of the sweeping process and add to the capacity required for the vacuum system. In addition, it has been found that such steel hoppers, when operating in the normal atmosphere, will deteriorate and rust through at the welded seams and through the side walls, thus requiring extended maintenance, repair and replacement.

Hence, those skilled in the art have been desirous of a vacuum truck having a less bulky, lighter weight hopper that may be mounted on a standard light duty truck chassis to improve vehicle fuel efficiency, minimize vehicle wear and tear, and reduce overall cost. The hopper should be constructed to minimize stagnant and turbulent flow patterns under operating vacuum and air flow conditions for enhanced vacuum efficiency. In addition, the hopper should offer a construction not prone to corrosion. Furthermore, it is desirable that the hopper incorporate a minimum number of components to facilitate ease of assembly, in turn, lowering manufacturing costs. The present invention meets these needs and others.

SUMMARY OF THE INVENTION

The present invention provides a vacuum sweeper truck having a hopper mounted thereon to collect swept debris from a roadway surface or the like. The hopper is fabricated of materials that resist corrosion and consequent deterioration while reducing weight so that the load handling requirements of the truck upon which it is mounted may be minimized.

In general, the vacuum sweeper truck includes a vacuum fan for drawing air and suspended debris from a sweeper head for deposit in a collection and storage hopper. The hopper is in the form of a seamless reinforced composite tank, such as fiberglass. The tank is formed by a continuous, integral, rounded peripheral wall formed with laterally disposed upper and lower longitudinally extending rounded corners. The tank terminates at its back end in a parametrical sealing flange configured to form a debris removal outlet. A screen partition is interposed between the debris inlet and vacuum outlet and includes a screen coextensive with and spaced from the top wall to cooperate therewith to define a return plenum from the screen to the vacuum outlet. A diverter is interposed between the tank inlet and outlet and extends from the front wall to the screen to direct air flow from the debris inlet to the vacuum outlet.

A rear door is hingedly connected to the rear of the tank and is disposed in closing relation over the back of the tank. The rear door includes a peripheral seal for engagement with the sealing flange of the tank when the door is closed. The vacuum system may be operated to draw the partial vacuum within the hopper to draw air and any suspended debris through the sweeper head and into the lower portion of the hopper to flow rearwardly therein. Such debris will thus be swept rearwardly with the air stream rushing rearwardly along the bottom wall and respective lower bottom corners to be drawn upwardly toward the screen. Debris is then screened out and falls downwardly in the hopper under its own weight. Air drawn upwardly through the screen will flow in a laminar air stream forwardly in the return plenum along the planar top wall and the laterally disposed rounded top corners to then be drawn downwardly into a vacuum outlet leading to the vacuum fan.

In a further aspect of the invention, the sealing flange of the tank includes a rearwardly facing substantially planar abutment surface having a seal affixed to the surface thereof so that when the rear door is closed over the back of the tank, the hopper is sealed from leakage of ambient air past the door and into the tank.

Other features and advantages of the invention will become apparent from the following detailed description taken in conjunction with the accompanying drawings, which illustrate by way of example, the features of the invention.

BRIEF DESCRIPTION OF THE DRAWINGS

FIG. 3 is a partial right side view of the vacuum truck similar to that shown in FIG. 2, illustrating the hopper in a raised dumping orientation;

FIG. 4 is a transverse end view taken along the line 4—4 of FIG. 3;

FIG. 5 is a partial end view taken along the line 5—5 of FIG. 3;

FIG. 6 is a transverse sectional view in enlarged scale taken along the line 6—6 of FIG. 3;

FIG. 7 is a longitudinal sectional side view of the hopper taken along line 7—7 of FIG. 6;

DETAILED DESCRIPTION OF THE PREFERRED EMBODIMENT

Figure 1:
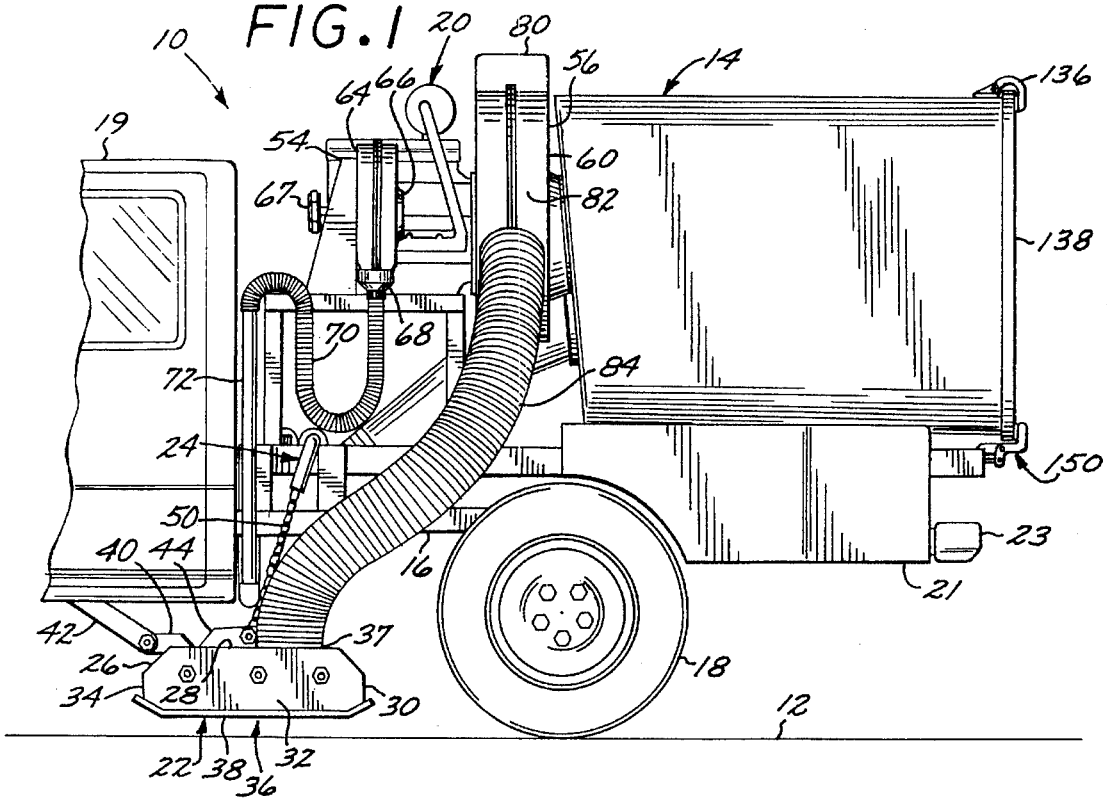
FIG. 1 is a partial left side view of a vacuum truck including a hopper embodying features of the present invention.

As shown in the drawings for purposes of illustration, the invention is embodied in a sweeper vehicle 10 for collecting debris from the surface 12 of a roadway or parking lot. In particular, the vehicle includes a lightweight hopper 14 for collecting such debris.

The invention provides an easily maneuverable, easy to operate vehicle 10 for conveniently sweeping roadway surfaces and parking lots. In particular, the vehicle includes a relatively lightweight, durable and high strength, corrosion resistant hopper 14 having desirable air flow characteristics. The hopper incorporates an integrally formed tank having a minimum number of peripheral components so that manufacturing costs are held to a minimum while facilitating ease of assembly.

Referring to the drawings, in accordance with the invention, the sweeper vehicle 10 includes a chassis frame 16 such as a light duty truck chassis, supported by four wheels 18 (two shown) and mounting a forward passenger cab 19 thereon. The frame mounts the hopper 14 atop the rear end thereof and includes a vacuum system 20 mounted between the cab and the hopper. In addition, the vehicle includes a pair of tool boxes 21 mounted to the frame 16 above and to the rear of the rear wheel 18. A rear bumper 23 is also affixed to the rear end of the frame for collision protection.

Figure 2:
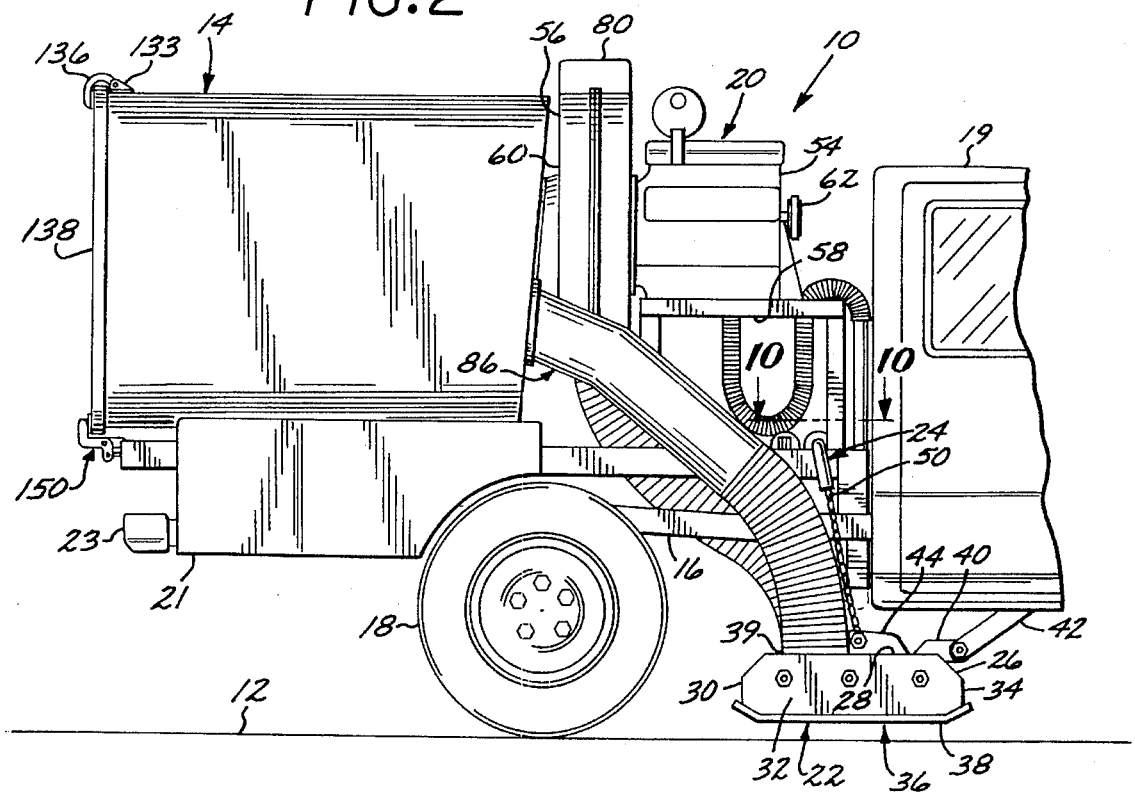
FIG. 2 is a partial right side view of the vacuum truck shown in FIG. 1.
Figure 10:
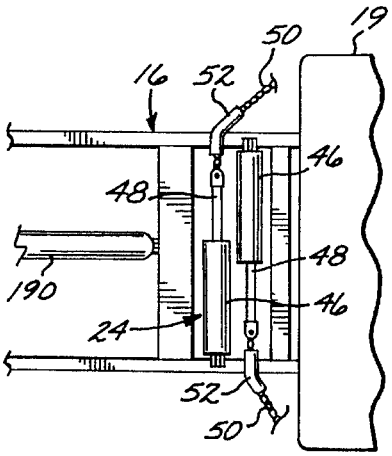
FIG. 10 is a partial horizontal sectional view taken along the line 10—10 of FIG. 2.
Figure 12:
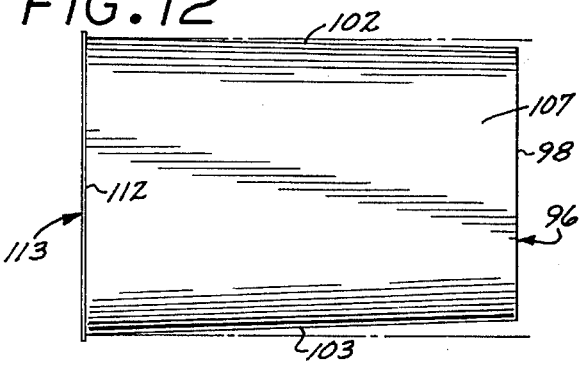
FIG. 12 is a side view of the hopper shown in FIG. 11.

Referring in particular to FIGS. 1, 2, and 10, a vacuum suction head 22 is suspended from the frame 16 ahead of the rear wheels 18 behind the cab 19. In particular, the vacuum head is suspended from the frame in a transverse orientation by a vertical height adjustment system 24, the details of which are described below.

The vacuum suction head 22 is of conventional construction and includes an elongated, generally rectangular body 26 having a top wall 28, a downwardly projecting rear wall 30, respective end walls 32 and a generally open forward end 34. A vertical downwardly facing flexible member (not shown), such as rubber flap, covers the forward end 34 of the head body to enclose the forward end of the vacuum head and define an open bottom side 36. The flexible member flexes to allow for relatively large articles to pass into such head when the sweeper vehicle is driven over debris. The respective bottom edges of the end walls each include a reinforced skid plate 38 welded thereto, having slightly upturned forward and rearward ends for sliding along the roadway surface 12 when the vacuum head is lowered into engagement with the roadway surface 12 when in operation. The top wall of the head body, at the driver side end thereof, includes a recirculation inlet 37 and, at the opposite end thereof, a vacuum head outlet 39. Referring to FIG. 1, the top wall of the head body, at the lateral opposite ends thereof, includes a pair of forward projecting arm brackets 40 affixed thereto for pivotal attachment at their front ends to respective rearwardly projecting mounting arms 42 carried pivotally from the chassis frame 16 below the cab 19. The lateral opposite ends of the top end of the vacuum head further include a pair of upstanding suspension brackets 44 for attachment to the height adjustment system 24.

With reference to FIGS. 1, 2 and 10, the height adjustment system 24 includes a pair of transversely extending, longitudinally spaced apart hydraulic cylinders 46 (FIG. 10) mounted atop the frame 16. The free ends of the respective cylinder piston rams 48 are attached to the upper ends of respective suspension chains 50 extending outwardly through elbow tubes 52 bent over the longitudinal chassis frame members. The respective bottom ends of the chains are affixed to the suspension brackets 44 atop the vacuum head 22.

To adjust the vertical height of the vacuum suction head 22, the operator may utilize controls in the cab to raise and lower the head to selected vertical positions above the roadway surface 12. To lower the vacuum head to its lowered operating position, the operator can actuate the controls to hydraulically actuate the cylinders 46 simultaneously to extend the respective rams 48. As such, the chains 50 extend downwardly under the weight of the head and the vacuum head pivots about the respective mounting arms 42 in a generally parallel relationship relative to the roadway surface 12. The vacuum head is lowered to an extent so that the respective laterally spaced apart skid plates 38 of the vacuum head engage the roadway surface. To raise the head, the operator actuates the cylinders to withdraw the rams within the cylinders pulling the chains inwardly to raise the head upwardly from the roadway surface in a stowed position.

Referring now to FIGS. 1 and 2, the vacuum system 20 can be described in detail. The vacuum system includes an engine 54 and a lightweight vacuum suction fan 56 mounted to the rear end thereof. The engine may be a lightweight, air-cooled, twenty five horsepower, gasoline powered internal combustion engine which may weigh on the order of ninety pounds. The engine is selected to provide adequate power while minimizing the overall weight of the sweeper vehicle 10. The engine and fan are mounted to a raised support frame 58 attached to the frame 16 of the vehicle 10. The fan includes a generally cylindrical lightweight fiberglass fan housing 60 having a lightweight stainless steel squirrel cage fan (not shown) mounted to an axially oriented drive shaft (not shown) of the engine. The opposite end of the drive shaft extends forwardly from the front of the engine and mounts a pulley 62.

As shown in FIG. 1, a blower 64 is mounted adjacent to the engine 54 and atop the support frame 58 of the vacuum system 20. The blower is a conventional high pressure blower having an air intake 66 and a forward projecting shaft mounting a pulley 67 including a belt engaged therewith and the pulley 62 of the engine. The blower includes and exhaust port 68 attached to a flexible length of blower conduit 70 the opposite end thereof attached to a rigid blower wand 72. The blower wand may be stowed on a stand so that the wand rests in a vertical position. The wand is stowed adjacent the rear of the cab near the driver window and door so that the operator may conveniently reach back from his driving position and grasp the wand. With the wand in hand and engine 54 in operation, the operator may direct blown air to gutters or the like and direct debris into the vacuum head 22 of the vehicle 10.

With particular reference to FIGS. 3 and 5, the vacuum fan 56 includes a rearwardly converging tapered inlet cowling 74 terminating in a radially inwardly turned circular vacuum inlet flange 76. Such flange is oriented to be disposed in a plane slightly canted downwardly and rearwardly (FIG. 3) to thus define at its inner diameter a slightly upwardly and rearwardly opening vacuum inlet 78. The inlet flange 76 of the vacuum fan may include a gasket, or the like, affixed thereto to effectuate a fluid seal between the hopper 14 and such vacuum fan when in mating engagement described below. In addition, the-top end of the fan housing has an upwardly projecting exhaust outlet 80 and an outwardly and downwardly directed recirculation air ejectment port 82 projecting toward the drivers side of the vehicle 10.

As shown in FIG. 1, the air ejectment port 82 of the fan housing 60 is affixed to one end of a flexible recirculation air conduit 84 and the opposite end thereof is affixed to the recirculation air inlet 37 of the vacuum head 22. When the vacuum fan 56 is in operation, recirculation air is partially exhausted from the vacuum fan and enters the vacuum head at the driver side end of the vacuum head and is directed toward the passenger side of the vacuum head. This recirculation air causes an agitated turbulent air flow pattern within the vacuum head that assists in dislodging debris from the roadway surface 12 as the vacuum head is drawn thereacross.

As shown in FIG. 3, a hopper inlet conduit 86 is connected between the top wall 28 of the vacuum head 22 and a hopper inlet fitting, generally designated 93, terminating in a rearwardly facing sealing flange 94 position to mate with the front wall of the hopper 14. The hopper inlet conduit includes a lower flexible bellows portion 88 and an upper duct portion 90 mounted to the support frame 58 of the vacuum system 20 by a mounting bracket 92 (FIG. 5). The sealing flange 94 is canted to slope rearwardly and downwardly at an angle substantially the same as the canted angle of the vacuum inlet flange 76. The angles of the respective flanges have been selected for complementary mating engagement with the front end of the hopper 14, as will be described hereinafter in detail. The sealing flange 94 of the hopper inlet conduit may include a gasket, or the like, affixed thereto to effectuate a fluid seal between the hopper and such conduit when in mating engagement.

Referring to the FIGS. and particularly to FIGS. 4, 6 and 7, the hopper 14 is constructed of lightweight reinforced composite materials such as fiberglass and includes, generally, an integrally molded seamless tank 96 in the form of an integral, generally tubularly shaped, peripheral wall to define a rectangular transverse cross section to provide generally planar top and bottom walls 102 and 103 and oppositely disposed side walls 106 and 107, all joined together at the respective laterally disposed corners by means of longitudinally extending top and bottom rounded corners 104 and 108, respectively. The peripheral wall terminates at its back extremity in an outturned parametrical sealing flange 112 (FIGS. 3 and 9) to encircle a debris removal outlet 113 and terminates at its front extremity in a plane which angles forwardly and upwardly at an angle complementary with that of the inlet flange 76 of the vacuum fan 56. The front end of the tank is closed by a front wall 98 formed centrally with a vacuum outlet opening 116 (FIG. 4) configured to be aligned with the vacuum fan inlet flange 76 of the vacuum fan 56 and formed at the lower right hand corner (FIG. 6) with a debris inlet opening 114 configured to be aligned with the sealing flange 94 of the hopper inlet fitting 93.

The respective rounded corners 104 and 108 are preferably formed with a radius of curvature of four inches. It is important that the corners be rounded to facilitate the molding process, enhance the structural integrity and to facilitate smooth air flow in the tank without undue turbulence or irregularities that might add to the flow resistance. The wall is constructed of reinforced fiberglass having the composition of a fiber substrate imbedded with hardened polymeric resin available under the trademark "CORMAT" from Clark-Schwebel, Santa Fe Springs, Calif., and is, in practice, between one-half and three quarters of an inch thick to provide the necessary structural integrity. With this construction, we have formed the tank with a height of 3', width of 5' and longitudinal length at the bottom of 4'. With this construction, the rounded corners should have a radius of curvature greater than one-half inch and may, if desirable, be increased up to the point where the peripheral wall is in the form of a round tube. The resultant tank, when empty, then weights about 225 pounds. It will be appreciated that, while the fiber substrate imbedded with polymeric resin is preferable, any form of reinforced polymeric composite which will provide the necessary structural integrity and preferably manufacturable with a seamless peripheral wall will be satisfactory.

Figure 11:
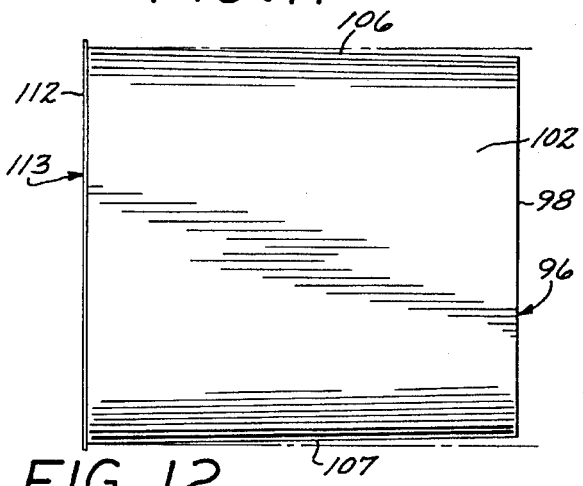
FIG. 11 is reduced in scale top view of the hopper shown in FIG. 1.

With reference to FIG. 11, the peripheral walls of the hopper tank 96 diverge slightly outwardly as they project rearwardly from the front wall 98 to form a slight funnel shape to facilitate dumping of the hopper 14 toward the back end thereof. In some instances, it may be found desirable to taper the respective walls in a diverging fashion toward the front of the hopper tank. In either event, this divergence produces a draft which is helpful in facilitating removal of the tank from the mold on which it is laid up during fabrication.

Referring to FIGS. 6 and 7, a laterally projecting diverter, generally designated 120, is interposed between the debris inlet opening 114 and the outlet opening 116 and includes a rearwardly extending contoured wall 122 turning laterally and upwardly to extend to the oppositely disposed side walls 106 and 107. The contoured wall turns upwardly from its rearward extremity to form a vertical wall 124 (FIG. 7) spaced behind the front wall in confronting relation over the outlet 116. The area between the front wall, vertical wall, side walls and contoured wall defines a vertical laminar air return plenum 126 to direct return air to the outlet 116. The tank 96 is formed in its side walls about six inches below the top wall with respective horizontally aligned, rearwardly opening screen tracks 130 extending forwardly to the vertical diverter wall 124. A rear closure panel 132 is bonded to the rear end of the tank above the screen tracks between the top wall 102 and the upper rounded corners 104.

A generally planar screen device 128 is provided having a thin rectangular rigid peripheral frame structure and is horizontally disposed a spaced distance from the top wall 102 of the hopper tank 96 and extends forwardly from the rear end of the tank between the respective side walls 106 and 107. The screen device is slidably received at its opposite marginal edges in the respective tracks 130 of the tank 96 to thereby form a screen divider between the lower space, rearward of the front wall debris inlet 114, to define a lower debris inlet chamber 118 and an upper horizontal return plenum 134 (FIG. 7). Alternatively, the screen device may be hingedly mounted at the forward end to the top end of the vertical dividing wall 124 so that the rear end of the screen device may be dropped to facilitate regular cleaning.

Figure 9:
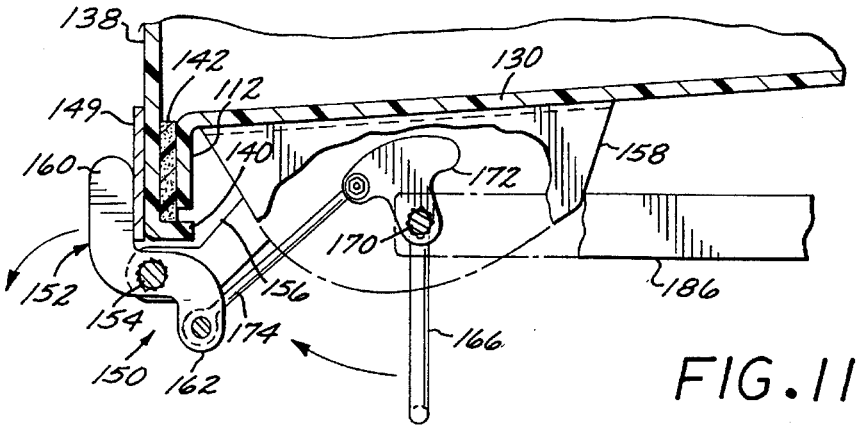
FIG. 9 is a sectional view, in enlarged scale, taken along the line 9—9 of FIG. 8.

Referring to FIGS. 3 and 9, formed integrally with the top wall 102 of the tank 96 at the back end thereof are a pair of hinge brackets 133 from which a rear door 138 is hung by means of hinge hangers 136. The door is configured around its periphery with a forwardly turned sealing lip 140 (FIG. 9) for encircling the sealing flange 112 of the tank and into which is nested a compressible seal 142 for being sandwiched against such flange.

The rear door 138 may fabricated in a similar manner as the tank 96 and may be composed of the same reinforced composite material or fiberglass to provide a corrosive resistant, lightweight, strong construction.

Figure 8:
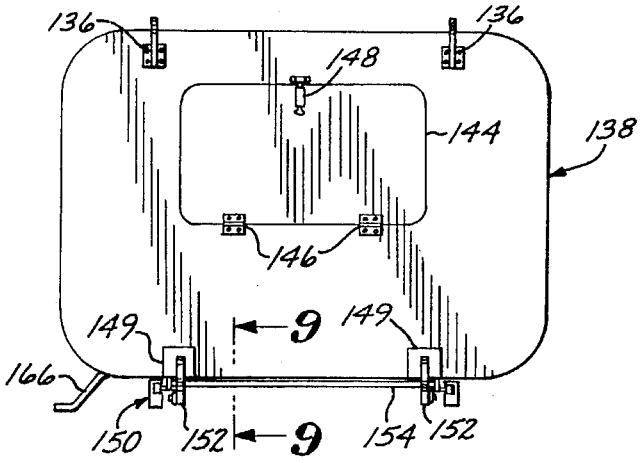
FIG. 8 is a reduced in scale end view of the rear door of the hopper.

As shown in FIGS. 8 and 9, the rear door 138 is held in closed position over the open back end of the tank 96 by a latching mechanism 150 acting on laterally spaced apart pressure pads 149 mounted to the bottom end of the rear door. The latching mechanism includes a pair of laterally spaced apart S-shaped latch arms 152 affixed in like orthogonal orientations relative to a transverse rod 154 affixed therebetween. The transverse rod is pivotally attached to the respective ends of a pair of laterally spaced apart, rearwardly projecting brackets 156 affixed to a pair of laterally spaced rear hopper mounting brackets 158, the hopper brackets bonded to the underside at the rear end of the tank 96. When the rod is rotated, the S-shaped arms pivot in a vertical plane. The respective S-shaped latch arms have on their respective first ends respective upstanding legs 160 which curve inwardly and downwardly to mount medially from the rod 154 and form at their respective opposite ends respective downturned legs 162.

Mounted forwardly underneath and tank and carried on its opposite end from the driver's side hopper mounting bracket 158 is a control pivot rod 170 (FIG. 9) which carries thereon an upstanding crank 172, the top end thereof pivotally connected with the downturned leg 162 of the driver's side latch arm 152 by a control link 174. A control bar 166 is rigidly carried on its top end from the control pivot rod 170 for facilitating rotation of such control rod to rotate the respective latch arms 152.

As shown in FIG. 8, such rear door 138 further includes, mounted high thereon, a generally rectangular, rearwardly opening centrally located inspection door 144 supported along its lower edge by hinges 146. A latch 148 is mounted on the rear door 138 along the top edge of the inspection door.

In the preferred configuration, the hopper 14 of the invention is constructed to have a two yard debris carrying capacity; however, larger or smaller capacity hoppers may be fabricated for different applications. It is to appreciated that the hopper 14, comprising the tank 96 and the rear door 138 attached thereto, weighs on the order of only two hundred and twenty five pounds which substantially reduces the load handling requirements for the vehicle upon which it is mounted. As such, the vehicle may be a light duty vehicle, rather than a heavy duty vehicle, which is less expensive to procure. In addition, the lightweight hopper increases vehicle fuel efficiency and minimizes wear and tear on the vehicle reducing maintenance costs. Furthermore, because lighter duty vehicles tend to have a shorter wheel base relative to heavier duty vehicles, a tighter turning radius may be attained and maneuverability of the vehicle increased.

Referring particularly to FIG. 3, the sweeper vehicle 10 also includes dumping mechanism 176 mounted on the chassis frame 16 thereof to carry the hopper 14 for raising thereof to a dumping position. Disposed forwardly of the rear mounting brackets 158 of the tank 96 and mounted to the bottom side of the bottom wall 103 is a pair of laterally spaced, centrally located downwardly projecting forward lift brackets 178.

The dumping mechanism 176 includes a pair of forwardly and rearwardly projecting, laterally disposed lifting arms 180 pivotally carried at their respective rear extremities from the chassis 16 for pivoting around respective pivot points 182 and connected on their respective opposite ends to the forwardly disposed mounting brackets 178 by means of kicker links 184. Respective longitudinally extending translating links 186 are pivotally connected medially to the central portion of the respective lifting arms 180 for pivoting relative thereto around respective pivot points 188 and include followers at their forward ends received in longitudinally projecting slider tracks (not shown). The translating links 186 are pivotally connected at their respective rear extremities to the respective rear hopper mounting brackets 158. A hydraulic piston 190 is pivotally connected at its forward extremity to the chassis and includes a piston rod 192 which is pivotally connected at its distal end to a cross bar extending between the respective lift arms 180 to thus control lifting and tilting of the hopper 14 and to control orientation and translation thereof.

With reference to FIGS. 1 and 2, in operation, the vacuum sweeper vehicle 10 may be operated with the hopper 14 in its lowered position shown in FIG. 1. With the vacuum head 22 raised to a vertically raised stowed position, the operator may drive the sweeper vehicle to a site, such as a parking lot requiring sweeping. When at the site, the operator may actuate the height adjustment system 24 to lower the vacuum head 22 into the desired spaced relation over the roadway surface 12. The operator may then start the engine 54 of the vacuum system 20 to generate vacuum suction within the vacuum head 22 while the recirculation air from the recirculation conduit 84 induces an agitated turbulent flow path within the vacuum head to assist in collecting debris. The operator may then drive the vehicle over debris in a sweeping pattern to sweep debris from the parking lot. It is to be appreciated that the recirculation air is directed through the vacuum head away from the driver's side of the vehicle so that any dust or particulates not captured by the hopper inlet conduit 86 tend to disperse on the passenger's side of the vehicle and not blow up to the operator's face enhancing the operator's comfort.

Figure 13:
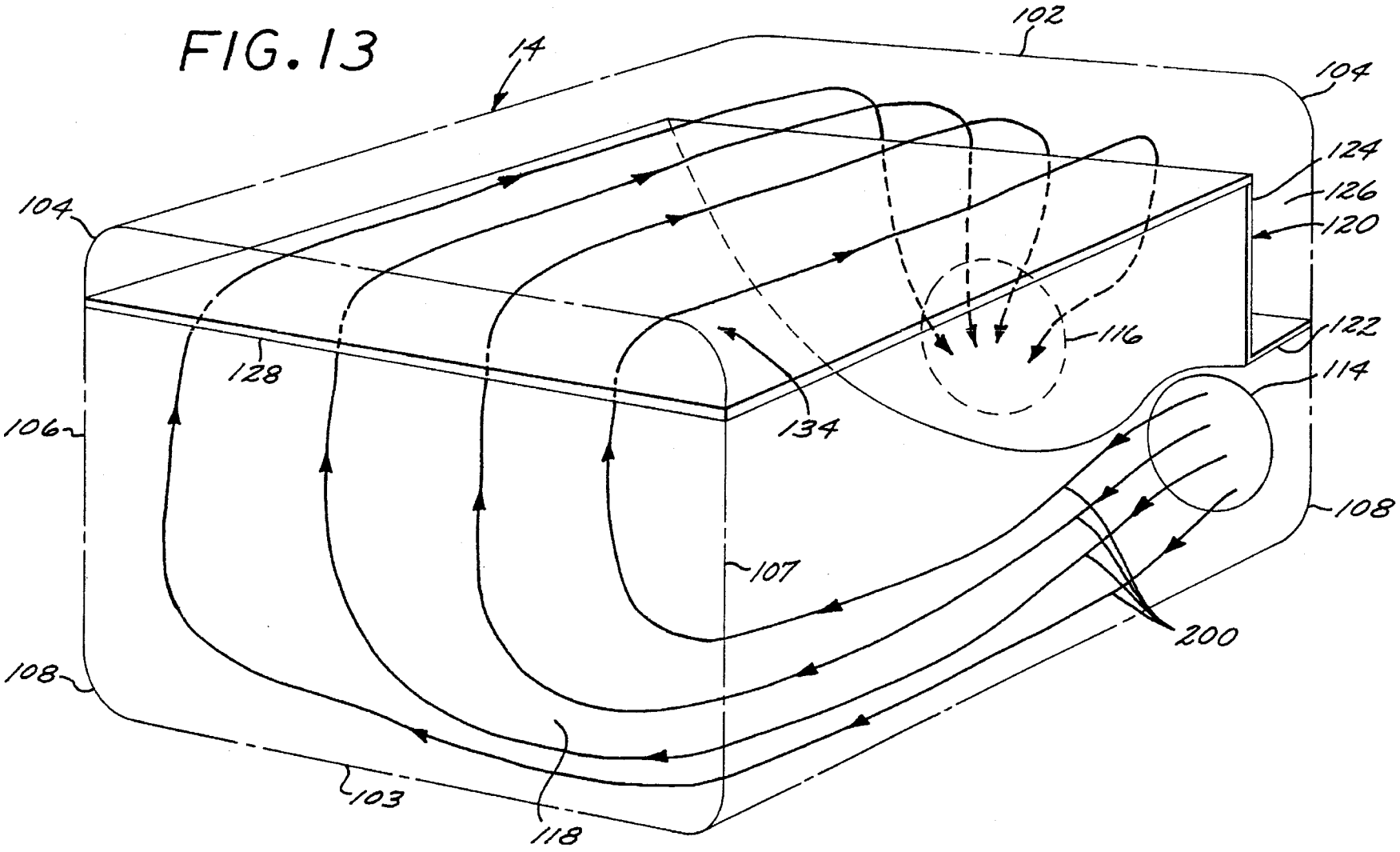
FIG. 13 is a diagrammatic, enlarged perspective view of the hopper shown in FIG. 1 and schematically depicting the air flow characteristics therethrough.

Referring particularly to FIGS. 6, 7 and 13, vacuum air flow and debris collecting characteristics of the hopper 14 can be described in detail. With the rear door 138 closed and the vacuum outlet 116 and the debris inlet 114 mated with the respective vacuum inlet flange 76 and hopper inlet fitting 93 of the vacuum head 22, the vacuum system 20 draws a partial vacuum within the hopper to create a pressure differential between the inlet 114 and outlet 116 to thereby induce flow along the path defined by the directional arrows 200 shown in FIG. 13. The partial vacuum drawn in the hopper tank will create a substantial pressure differential across the walls thereof. The peripheral wall will thus be placed under high compressive forces. The high strength fiberglass structure of the tank 96 is, in combination with the rounded corners, operative to withstand the high pressure differentials applied.

As the vacuum head 22 is drawn over the roadway surface 12, debris suspended in a vacuum air stream is carried through the hopper inlet conduit 86 into the hopper debris inlet 114 of the hopper. As vacuum air enters the hopper through the debris inlet 114, the debris suspended therein will be swept rearwardly in the tank 96 along the bottom wall 103 and respective lower rounded corners 108 in an essentially laminar flow pattern tending to sweep loose debris rearwardly along the bottom wall and rounded bottom corners. The vacuum air is then drawn upwardly to the screen device 128 to screen out such debris. Because the area of the screen 128 is relatively large, the relative velocity of air passing therethrough is reduced to approximately zero and minimizes the pressure differential thereacross. Consequently, upwardly acting air induced forces on the debris particles is reduced to thereby leave such particles free to drop under the influence of gravity to the bottom of the hopper 14. As the air is drawn upwardly through the screen, the filtered air flows forwardly therefrom in the horizontal return plenum 134 along the top wall 102 and the laterally disposed top rounded corners 104. Thereafter, the filtered air is drawn downwardly in the vertical return plenum 126 through the vacuum outlet 116 and into the vacuum inlet 78 of the vacuum fan 56. A portion of the vacuum air is exhausted from the exhaust outlet 80 of the vacuum fan and the remaining air is directed through the recirculation conduit 84 to the vacuum head as described above.

As noted above, it will be appreciated that the air flow pattern through the hopper tank is highly efficient for maintaining an efficient laminar flow stream and avoiding stagnant air pockets in the top or bottom corners thereof and in maintaining a flow stream that, when the tank empty of debris, serves to sweep along the opposed rounded corners 108 and bottom wall 103 thereof to thus initially sweep the debris rearwardly in such tank toward the back wall thereof to be deposited rearwardly in the tank. Any suspended debris particles will then tend to be carried by the momentum of the flowing air rearwardly in such tank and, to the extent such debris particles do not drop out under the influence of gravity, will tend to be drawn rearwardly to move upwardly with the mass of air flow toward the rear extremity of the screen 128 to be arrested at the bottom face of the screen to cause the velocity thereof to be brought to approximately zero. This then leaves the debris particles subject to be drawn downwardly under the influence of gravity to drop toward the bottom wall 103. The air stream then moving upwardly through the rear extremity of the screen 128 will thus be drawn forwardly in the horizontal plenum 134 in a substantially laminar flow. The rounded corners 104 will then to induce such laminar flow throughout the full cross sectional area of the flow stream to thus avoid stagnation points which might otherwise take place in the orthogonal corners of a square cornered tank and the consequent eddies and disruption of flow which might otherwise hinder and resist the efficient laminar flow pattern. Consequently, the pressure differential from the inlet 114 along the debris inlet chamber 118 and across the screen 128 and then forwardly along the horizontal plenum 134 and downwardly in the vertical return plenum 126 will be maintained at a cumulative minimum so that the magnitude of the partial vacuum generated in the hopper inlet conduit 86 and the vacuum head 22 will be maintained at a high level to thereby enhance the efficiency of the vacuum sweeping process and minimizing the power necessary for efficient cleaning.

It will be appreciated that when the high partial vacuum is maintained within the tank, the pressure differential across the rear door 138 will be maintained relatively high thus tending to compress the seal 142 (FIG. 9) between the periphery of such door and the sealing flange 112 to thereby maintain a high effective positive seal. The positioning of such door 138 on the sealing flange 112 to maintain a positive uniform compression on the seal 142 about the periphery of the back end of the tank is provided by the overlapping relationship of the forwardly turned marginal lip 140 projecting around the exterior edge of the laterally turned sealing flange 112 as shown in FIG. 9. This serves to maintain a positive and high integrity seal to thus avoid air leakage and consequent deterioration of the integrity of the partial vacuum maintained in the tank.

Since the hopper 14 is relatively lightweight, it will be appreciated that as debris is drawn thereinto and the hopper loaded during the sweeping process, the cumulative weight on the truck chassis is maintained at a minimum. When the sweeping process has been completed, or a full load of debris has been collected in the hopper, the vacuum system 20 may be deenergized and the vacuum head 22 raised. The sweeper vehicle may then be driven to a dump site for unloading thereof. It will be appreciated that, since the hopper is relatively lightweight, the limitation on the amount of debris loaded thereinto is not severe since the composite weight of the hopper, debris load and the truck upon which such hopper is mounted is minimized.

When the dump site is reached, the operator may unlatch the bottom of the rear door 138 by actuating the control bar 166 of the latching mechanism 150 to rotate the bottom end of the control bar (FIG. 9) rearwardly to rotate the rod 170 clockwise thereby rotating the crank 172 clockwise to draw the control link 174 upwardly to the right as viewed in FIG. 9 to thereby rotate the latch arms 152 counterclockwise. Rotation of the latch arms 152 counterclockwise thus serves to rotate the upstanding latch legs 160 clear of the respective pressure pads 149 to thus free the bottom extremity of the door 138.

The controls of the dumping mechanism 176 may then be actuated to extend the piston rod 192 of the dump piston 190 (FIG. 3). It will be appreciated that in the lowered position of the hopper 14 the kicker links 184 are oriented in a position counterclockwise of that shown in the position depicted in FIG. 3 to project essentially rearwardly parallel with the lift arms 180. Consequently, upon the initial actuation of the dump piston 190, the lift arms 180 are rotated counterclockwise about its rear extremity causing the kicker links 184 to rotate at a relatively high angular rate of speed in a clockwise direction relative to its bottom extremity. This kinematic relationship thus causes the hopper 14 to be raised upwardly and shifted rearwardly to thus shift the front wall 98 of the tank 96 rearwardly and upwardly to disengage the vacuum inlet flange 76 of the vacuum system 20 thus leaving the front of the tank clear to be further shifted to its elevated position shown in FIG. 3. As the dump piston 190 extends, the translation links 186 will be drawn rearwardly by the respective pivot connections 188 thereby tending to translate the rear extremity of the hopper 14 upwardly toward the elevated position shown in FIG. 3 while the compound movement of the lift arm 180 and kicker links 184 serve to elevate the front extremity of such tank to a greater degree thus elevating the entire tank and locating it to the rearwardly and downwardly inclined position shown in FIG. 3 causing the rear door 138 to swing to the open position so that debris in the collection hopper will be flowed outwardly and rearwardly. It will be appreciated that, since the peripheral walls of the tank itself expand slightly outwardly and rearwardly towards the rear end thereof, a path will be defined which is slightly expanding in cross section to thereby create a generally expanding path for the cross section of such debris to thereby avoid unwanted packing or compression of such debris which otherwise might intend to restrict rearward and downwardly free flow thereof for rapid and unrestricted dumping.

It will be appreciated that the relative light weight of the hopper 14 tends to minimize the hydraulic pressure which must be applied by the dump piston 190 to effect proper and efficient dumping thereof. Moreover, the reduced weight minimizes the necessary structural mass of the dump linkage mechanism 176 and reduces the danger of imbalance on the overall vehicle resulting from the relatively high center of gravity and shifting of the combined weight of the debris and tank during translation to the elevated position shown in FIG. 3.

After the debris has been dumped, the dump controls may be reversed thereby retracting the piston 190 allowing the dumping mechanism 176 to contract thereby lowering the hopper 14 and allowing the lift arms 180 to rotate clockwise to its lowered essentially horizontal position while the kicker links 184 rotate simultaneously counterclockwise thus cooperating with the translation arms 186 and lifting arms 180 to maneuver the front wall 98 of the tank 96 into positive sealing engagement with the vacuum inlet flange 76 and hopper inlet flange 94 as shown in FIGS. 1 and 2.

Lowering of the hopper 14 in this manner allows the sealing flange 112 of the tank 96 to assume its orientation in a vertical plane thus causing the rear door 138 to assume its vertical position in sealing orientation overlying the seal 142 on the flange 112. The latching mechanism 150 may then be actuated to draw the bottom extremity of the control bar 166 forwardly to rotate the rod 170 in a counterclockwise direction thus driving the control link 174 downwardly to the left causing the respective latch arms 152 to rotate clockwise and shift to their locking position shown in FIG. 9.

From the foregoing, it can be appreciated that the present the invention provides a vacuum truck having a lightweight hopper of minimum bulk that may be mounted on a standard light duty truck chassis. The hopper contributes to vehicle maneuverability, fuel efficiency, minimizes vehicle wear and tear, and reduces overall cost. The hopper is constructed to minimize stagnant and turbulent flow patterns therein and enhances vacuum efficiency. In addition, the hopper offers a fiberglass molded construction that reduces the possibility of corrosion. Furthermore, because the hopper is of molded fiberglass, it is inexpensive to manufacture and incorporates a minimum number of components to facilitate ease of assembly and enhance reliability.

While particular forms of the invention have been illustrated and described, it will be apparent that various modifications can be made without departing from the spirit and scope of the invention.

What is claimed is:

1. A hopper for mounting to a vacuum truck chassis including a vacuum system for drawing a predetermined partial vacuum at a vacuum fan inlet and having a suspended vacuum sweeper head including a debris conduit leading to a debris outlet, said hopper comprising:

a hopper tank formed with a front wall having a vacuum outlet for mating with said vacuum fan inlet and a debris inlet for mating with said debris outlet, a peripheral wall formed with pairs of laterally disposed respective upper and lower longitudinally extending rounded corners formed integrally between respective laterally disposed side walls and respective top and bottom walls;

said tank terminating at its back end in a sealing flange configured to form a debris removal outlet;

a screen partition interposed between said debris inlet and vacuum outlet and including a screen spaced from said top wall and cooperating with said peripheral wall to form therebelow a debris collection chamber and thereabove a return plenum chamber extending to said vacuum outlet;

a diverter interposed between said debris inlet and said vacuum outlet and extending from said front wall to said screen to direct air flow from said debris inlet to said vacuum outlet;

a rear door hingedly connected to the rear of said tank to be disposed in closing relation over the back of said tank; and a peripheral gasket on said door for sealing engagement with said sealing flange whereby when said door is closed and said vacuum outlet and said debris inlet are mated with said respective vacuum inlet and debris outlet and said vacuum system operated to draw said partial vacuum, debris suspended in air drawn through said vacuum head through said conduit into said debris inlet will be swept along rearwardly in said tank along said bottom wall and respective lower bottom corners to be drawn upwardly to said screen allowing the debris to fall downwardly in said tank and, as said air is drawn upwardly through said screen, removing the remaining debris out of said air to cause the filtered air to flow forwardly in said return plenum along said top wall and said laterally disposed top corners to then be drawn into said vacuum outlet.

2. The hopper of claim 1 wherein:

said respective upper and lower longitudinally extending corners have a radius of 4 inches.

3. The hopper of claim 1 wherein:

said front wall of said tank cants downwardly and rearwardly from said top wall to said bottom wall and said bottom wall slopes downwardly and rearwardly from said front wall to the rear end of said tank.

4. The hopper of claim 1 wherein:

said tank is constructed of reinforced fiberglass.

5. The hopper of claim 1 wherein:

said peripheral wall constructed of seamless reinforced fiberglass incorporating a hardened polymeric resin.

6. The hopper of claim 1 wherein:

said peripheral wall tapers outwardly and rearwardly to form said debris collection compartment to expand outwardly and rearwardly.

7. The hopper of claim 1 wherein:

said diverter is constructed of fiberglass and includes a horizontal section projecting rearwardly from said front wall and turns upwardly to form a vertical section disposed in confronting relation with said vacuum outlet.

8. The hopper of claim 1 for use with a vacuum system including a fan housing configured with a rearwardly facing fan sealing flange disposed in a plane angling rearwardly and downwardly at a predetermined angle and wherein:

said front wall is configured to angle rearwardly and downwardly at said predetermined angle to mate with said fan sealing flange.

9. The hopper of claim 1 that includes:

hinge hanger brackets bonded to said top wall at the rear thereof; and hinge hangers pivotally hung from said hanger brackets and bonded to the top edge of said door.

10. The hopper of claim 1 wherein:

said sealing flange is in the form of an outwardly turned peripheral flange; and said sealing gasket is configured to overlie said peripheral flange.

11. The hopper of claim 1 wherein:

said sealing flange is in the form of an outwardly turned peripheral flange; and said door is configured to be disposed in overlying relation over said flange and includes a forwardly turned peripheral lip surrounding said flange.

12. The hopper of claim 1 wherein:

said front wall, peripheral wall and back door are constructed of fiberglass reinforced with a fiber substrate imbedded with hardened polymeric resin.

13. The hopper of claim 1 wherein:

said side walls converge laterally inwardly toward one end of said tank.

14. A vacuum sweep vehicle for collecting debris from a roadway surface, said vehicle comprising:

a wheeled vehicle chassis mounting a passenger cab;

a suspended vacuum sweeper head including a debris conduit leading to a debris outlet;

a height adjusting means attached to said chassis and said sweeper head for vertically adjusting the height of said head relative to said roadway surface;

a vacuum system mounted on said chassis, said system having an vacuum inlet;

a fiberglass hopper mounted on said chassis for collecting refuse gathered from said vacuum head, said hopper including a seamless fiberglass tank formed with a front wall having a vacuum outlet for mating with said vacuum inlet and a debris inlet for mating with said debris outlet, a peripheral wall formed with pairs of laterally disposed respective upper and lower longitudinally extending rounded corners formed integrally between respective laterally disposed side walls the respective top and bottom walls;

said tank terminating at its rear end in a peripheral sealing flange configured to form a debris removal outlet;

a screen partition interposed between said debris inlet and vacuum outlet and including a screen spaced from said top wall to cooperate therewith to define a return plenum from said screen to said vacuum outlet;

a diverter interposed between said inlet and outlet and extending from said front wall to said screen to direct air flow from said debris inlet to said vacuum outlet;

a rear door hingedly connected to the rear of said tank to be disposed in closing relation over the back of said tank and including a peripheral seal for sealing engagement with said sealing flange whereby when said door is closed and said vacuum outlet and said debris inlet mated with said respective vacuum inlet and debris outlet and said vacuum system operated to draw said partial vacuum, debris suspended in air drawn through said sweeper head through said conduit into said debris inlet will be swept along rearwardly in said tank along said bottom wall and respective lower bottom corners to be drawn upwardly to said screen allowing the debris to fall downwardly in said tank and, as said air is drawn upwardly through said screen, removing the remaining debris out of said air to cause the filtered air to flow forwardly in said return plenum along said top wall and said laterally disposed top corners to then be drawn into said vacuum outlet.

15. The vacuum sweep vehicle of claim 14 wherein said peripheral seal of said door includes a gasket affixed to said door so that when said door is closed over the rear end of said tank, said gasket seals said hopper from leakage of air past said door and into said tank.

16. The vacuum sweep vehicle of claim 14 wherein said respective upper and lower longitudinally extending corners have a radius of 4 inches.

17. The vacuum sweep vehicle of claim 14 wherein said front wall of said tank cants downwardly and rearwardly from said top wall to said bottom wall and said bottom wall slopes downwardly and rearwardly from said front wall the rear end of said tank.

18. The vacuum sweep vehicle of claim 14 wherein;

said vehicle further includes a dumping linkage mounted between said hopper and said chassis connected to a drive ram pivotally mounted to said chassis and said dumping linkage, to upon extending said ram, drive said linkage to simultaneously raise and tilt said hopper to a predetermined orientation relative to said roadway surface.

19. A hopper for mounting to a vacuum truck chassis including a vacuum system for drawing a predetermined partial vacuum at a vacuum fan inlet and having a suspended vacuum sweeper head including a debris conduit leading to a debris outlet, said hopper comprising:

a hopper tank formed with a front wall having a vacuum outlet for mating with said vacuum fan inlet and a debris inlet for mating with said debris outlet, a peripheral wall formed with pairs of laterally disposed respective upper and lower longitudinally extending rounded corners formed integrally between respective laterally disposed side walls and respective top and bottom walls;

said front wall of said tank canting downwardly and rearwardly from said top wall to said bottom wall and said bottom wall sloping downwardly and rearwardly from said front wall toward the rear end of said tank;

said tank terminating at its back end in a sealing flange configured to form a debris removal outlet;

a screen partition interposed between said debris inlet and vacuum outlet and including a screen spaced from said top wall and cooperating with said peripheral wall to form therebelow a debris collection chamber and thereabove a return plenum chamber extending to said vacuum outlet;

a diverter interposed between said debris inlet and said vacuum outlet and extending from said from wall to said screen to direct air flow from said debris inlet to said vacuum outlet;

a rear door hingedly connected to the rear of said tank to be disposed in closing relation over the back of said tank and including a peripheral seal for sealing engagement with said sealing flange whereby when said door is closed and said vacuum outlet and said debris inlet are mated with said respective vacuum inlet and debris outlet and said vacuum system operated to draw said partial vacuum, debris suspended in air drawn through said vacuum head through said conduit into said debris inlet will be swept along rearwardly in said tank along said bottom wall and respective lower bottom corners to be drawn upwardly to said screen allowing the debris to fall downwardly in said tank and, as said air is drawn upwardly through said screen, removing the remaining debris out of said air to cause the filtered air to flow forwardly in said return plenum along said top wall and said laterally disposed top corners to then be drawn into said vacuum outlet.

20. A hopper for mounting to a vacuum truck chassis including a vacuum system for drawing a predetermined partial vacuum at a vacuum fan inlet and having a suspended vacuum sweeper head including a debris conduit leading to a debris outlet, said hopper comprising:

a hopper tank formed with a front wall having a vacuum outlet for mating with said vacuum fan inlet and a debris inlet for mating with said debris outlet, a peripheral wall constructed of seamless reinforced fiberglass incorporating a hardened polymeric resin and formed with pairs of laterally disposed respective upper and lower longitudinally extending rounded corners formed integrally between respective laterally disposed side walls and respective top and bottom walls;

said tank terminating at its back end in a sealing flange configured to form a debris removal outlet;

a screen partition interposed between said debris inlet and vacuum outlet and including a screen spaced from said top wall and cooperating with said peripheral wall to form therebelow a debris collection chamber and thereabove a return plenum chamber extending to said vacuum outlet;

a diverter interposed between said debris inlet and said vacuum outlet and extending from said front wall to said screen to direct air flow from said debris inlet to said vacuum outlet;

a rear door hingedly connected to the rear of said tank to be disposed in closing relation over the back of said tank and including a peripheral seal for sealing engagement with said sealing flange whereby when said door is closed and said vacuum outlet and said debris inlet are mated with said respective vacuum inlet and debris outlet and said vacuum system operated to draw said partial vacuum, debris suspended in air drawn through said vacuum head through said conduit into said debris inlet will be swept along rearwardly in said tank along said bottom wall and respective lower bottom corners to be drawn upwardly to said screen allowing the debris to fall downwardly in said tank and, as said air is drawn upwardly through said screen, removing the remaining debris out of said air to cause the filtered air to flow forwardly in said return plenum along said top wall and said laterally disposed top corners to then be drawn into said vacuum outlet.

21. A hopper for mounting to a vacuum track chassis including a vacuum system for drawing a predetermined partial vacuum at a vacuum fan inlet and having a suspended vacuum sweeper head including a debris conduit leading to a debris outlet, said hopper comprising:

a hopper tank formed with a front wall having a vacuum outlet for mating with said vacuum fan inlet and a debris inlet for mating with said debris outlet, a peripheral wall formed with pairs of laterally disposed respective upper and lower longitudinally extending rounded corners formed integrally between respective laterally disposed side walls and respective top and bottom walls;

said peripheral wall tapers outwardly and rearwardly to form said debris collection compartment to expand outwardly and rearwardly;

said tank terminating at its back end in a sealing flange configured to form a debris removal outlet;

a screen partition interposed between said debris inlet and vacuum outlet and including a screen spaced from said top wall and cooperating with said peripheral wall to form therebelow a debris collection chamber and thereabove a return plenum chamber extending to said vacuum outlet;

a diverter interposed between said debris inlet and said vacuum outlet and extending from said front wall to said screen to direct air flow from said debris inlet to said vacuum outlet;

a rear door hingedly connected to the rear of said tank to be disposed in closing relation over the back of said tank and including a peripheral seal for sealing engagement with said sealing flange whereby when said door is closed and said vacuum outlet and said debris inlet are mated with said respective vacuum inlet and debris outlet and said vacuum system operated to draw said partial vacuum, debris suspended in air drawn through said vacuum head through said conduit into said debris inlet will be swept along rearwardly in said tank along said bottom wall and respective lower bottom corners to be drawn upwardly to said screen allowing the debris to fall downwardly in said tank and, as said air is drawn upwardly through said screen, removing the remaining debris out of said air to cause the filtered air to flow forwardly in said return plenum along said top wall and said laterally disposed top corners to then be drawn into said vacuum outlet.

* * * * *